United States Patent [19]

Shibuya

[11] 4,269,576

[45] May 26, 1981

[54] VANE COMPRESSOR WITH RETICULATE OR POROUS SEPARATOR ELEMENT AND FLUID GUIDE MEANS THEREIN

[75] Inventor: Tsunenori Shibuya, Konan, Japan

[73] Assignee: Diesel Kiki Co., Ltd., Saitama, Japan

[21] Appl. No.: 52,344

[22] Filed: Jun. 27, 1979

[30] Foreign Application Priority Data

Jul. 29, 1978 [JP] Japan ..... 53-104580

[51] Int. Cl.[3] ..... F04C 29/02; B01D 39/04; B01D 50/00

[52] U.S. Cl. ..... 418/97; 418/DIG. 1; 55/259; 55/523

[58] Field of Search ..... 418/93, 97-100, 418/DIG. 1; 62/470, 473; 55/233, 259, 522, 523

[56] References Cited

U.S. PATENT DOCUMENTS

| | | | |
|---|---|---|---|
| 2,049,211 | 7/1936 | Loweke | 418/97 |
| 2,496,676 | 2/1950 | Rawson | 418/97 |
| 3,385,513 | 5/1968 | Kilgore | 418/98 |
| 3,684,412 | 8/1972 | Harlin et al. | 418/97 |
| 3,743,453 | 7/1973 | Abendschein et al. | 418/97 |
| 3,776,668 | 12/1973 | Abendschein | 418/97 |
| 3,865,515 | 2/1975 | Allen | 418/97 |

*Primary Examiner*—John J. Vrablik

*Attorney, Agent, or Firm*—Frishauf, Holtz, Goodman and Woodward

[57] ABSTRACT

An improved vane compressor including a novel lubricating oil separator means disposed within a discharge pressure chamber formed between the casing and the pump housing. The oil separator means comprises an element having a reticulate or spongy structure having pores communicating with each other and a shape substantially similar to that of the discharge pressure chamber, and baffle board guide means arranged for guiding fluid travelling in said element toward the outlet of the compressor. The oil separator element has a channel continuously formed in peripheral surfaces and an end surface thereof and adapted to cooperate with an associated inner surface of the discharge pressure chamber to form an oil passage for facilitating charge and discharge of oil through the oil charge and discharge port of the compressor.

5 Claims, 7 Drawing Figures

VANE COMPRESSOR WITH RETICULATE OR POROUS SEPARATOR ELEMENT AND FLUID GUIDE MEANS THEREIN

BACKGROUND OF THE INVENTION

The present invention relates to a vane compressor for compressing a refrigerant or like material.

A vane compressor is already known e.g., from U.S. Pat. No. 2,522,824 and U.S. Pat. No. 3,834,846 which is of the type including a rotary shaft arranged to be rotated by an associated prime mover; a rotor secured to said rotary shaft for rotation in unison therewith and having a plurality of slits formed in an outer peripheral surface thereof; a plurality of vanes radially movably inserted in said slits; and a pump housing with its interior formed as an endless cam surface accomodating said rotor and said vanes, the rotor, the vanes and the pump housing cooperating to define pump working chambers between them; a casing enclosing said pump housing in a fashion defining a discharge pressure chamber between the pump housing and the casing, whereby rotation of the rotor causes a refrigerant introduced in the pump working chambers to be pressurized for delivery outside the casing via the discharge pressure chamber.

The refrigerant contains a lubricating oil dispersed therein for lubrication of sliding machine parts of the compressor. The lubricating oil is discharged from the compressor together with the refrigerant and is fed to an evaporator and a condenser associated with the compressor. However, some of the lubricating oil stays in the evaporator and the condenser, causing a reduction in the heat transfer rate of these units. To prevent this, conventionally an oil separating element made of wire gauze is mounted on the inlet of the discharge pressure chamber. However, such conventional type oil separator does not effectively separate the oil from the refrigerant, particularly when used in an apparatus having a high rotational speed and accordingly a high oil consumption such as a vane compressor. In addition, it is heavy in weight and requires a rather high manufacturing cost.

BRIEF SUMMARY OF THE INVENTION

It is therefore a primary object of the invention to provide a vane compressor which is capable of efficiently separating the oil from the refrigerant, is light in weight and can be economically manufactured.

It is a further object of the invention to provide a vane compressor in which the flow of fluid travelling in the discharge pressure chamber is directed toward the outlet of the compressor and accordingly the travelling speed of the fluid is not decreased when the fluid passes the discharge pressure chamber.

It is another object of the invention to provide a vane compressor which is equipped with an oil separator element which is designed to facilitate the charge and discharge of lubricating oil through an oil charge and discharge port formed in the casing of the compressor, thus permitting the manufacture and maintenance of the compressor to be carried out efficiently.

Further objects, features and advantages of the present invention will be made apparent from the ensuing description taken in connection with the accompanying drawings.

DETAILED DESCRIPTION

Figure 1:
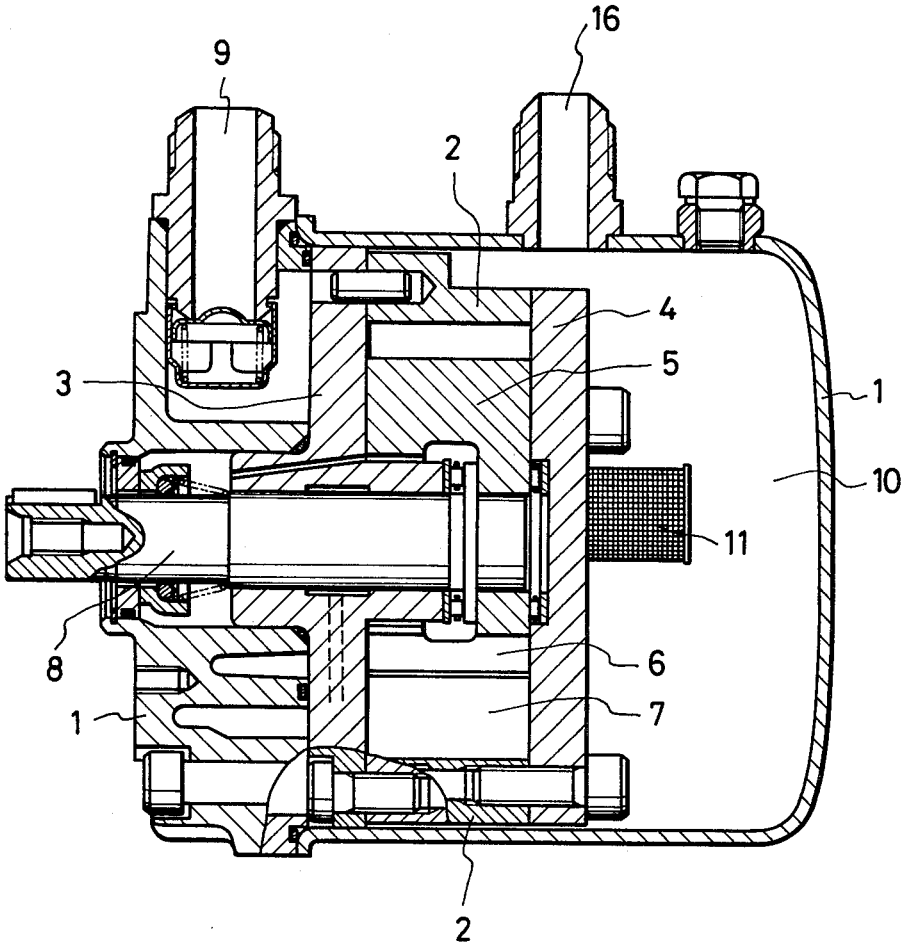
FIG. 1 PRIOR ART
FIG. 1 is an axial sectional view of a conventional type vane compressor.
Figure 2:
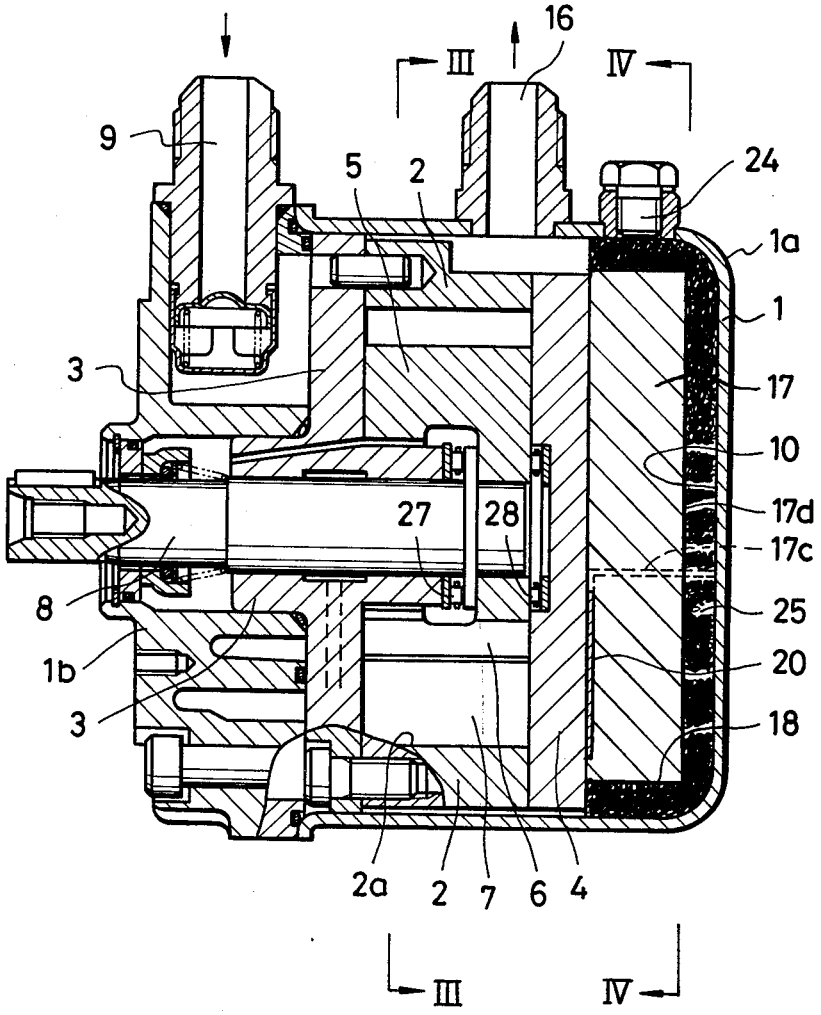
FIG. 2 is an axial sectional view of a vane compressor according to an embodiment of the invention.

A conventional type vane compressor is illustrated in FIG. 1. A cam ring 2 is disposed within the casing 1 of the compressor. A rotor 5 is disposed within a cavity defined by the inner wall of the cam ring 2 and the inner surfaces of side wall members 3, 4 secured to the opposite sides of the cam ring 2. The rotor 5 has a plurality of radially directed slits formed over a periphery thereof, in which a plurality of vanes 7 are inserted.

When a drive shaft 8 to which the rotor 5 is secured is rotated, the rotor 5 is rotated, which causes spaces defined between the inner wall of the cam ring 2, the inner walls of the side wall members 3, 4 and adjacent ones of the vanes 7 to become expanded and contracted repeatedly so that fluid such as refrigerant is sucked into said spaces through a compressor inlet 9, compressed therein and discharged through pump outlets, not illustrated, into a discharge pressure chamber 10 formed between the cam ring 2, the rear side wall 4 and the casing 1. The fluid in the chamber 10 is discharged through a compressor outlet 16 after temporarily staying in the chamber 10.

The fluid such as refrigerant contains a lubricating oil dispersed therein. An oil separating wire gauze 11 is arranged to surround the pump outlets for separation of lubricating oil from the fluid introduced into the discharge pressure chamber 10.

However, satisfactory oil separation results cannot be obtained with such wire gauze-made oil separator 11 particularly when used in an apparatus having a high rotational speed and accordingly a high oil consumption such as a vane compressor. Further, the oil separator of such type is heavy in weight and is expensive.

An embodiment of the invention will now be described with reference to FIGS. 2 through 7.

FIGS. 2 through 5 illustrate a vane compressor according to the invention. A cylindrical cover 1*a* is secured to a front head 1*b* to form a casing 1 as a whole. The casing 1, which is horizontally disposed, accomodates a cam ring 2 having an interior thereof formed as an endless cam surface 2*a* of ellipsoid section. A pair of side wall members 3, 4 are secured to the opposite sides of the cam ring 2 to cooperate with the cam ring 2 to form a pump housing. A discharge pressure chamber 10 is formed between the side wall 4 and the cover 1*a*. A rotor 5 is disposed within a chamber 13 defined in the pump housing by the inner walls of the cam ring 2 and the side walls 3, 4. The rotor 5 is fitted on and secured to a rotary shaft 8 penetrating the front head 1*b* and the front side wall 3 and is kept in sliding contact with the side walls 3, 4 via thrust bearings 27, 28, respectively.

The rotor 5 has its peripheral lateral surface formed with a plurality of axial slits 6 radially opening and circumferentially spaced from each other at equal intervals. Vanes 7 as many as slits 6 are radially movably inserted in these slits 6.

Figure 3:
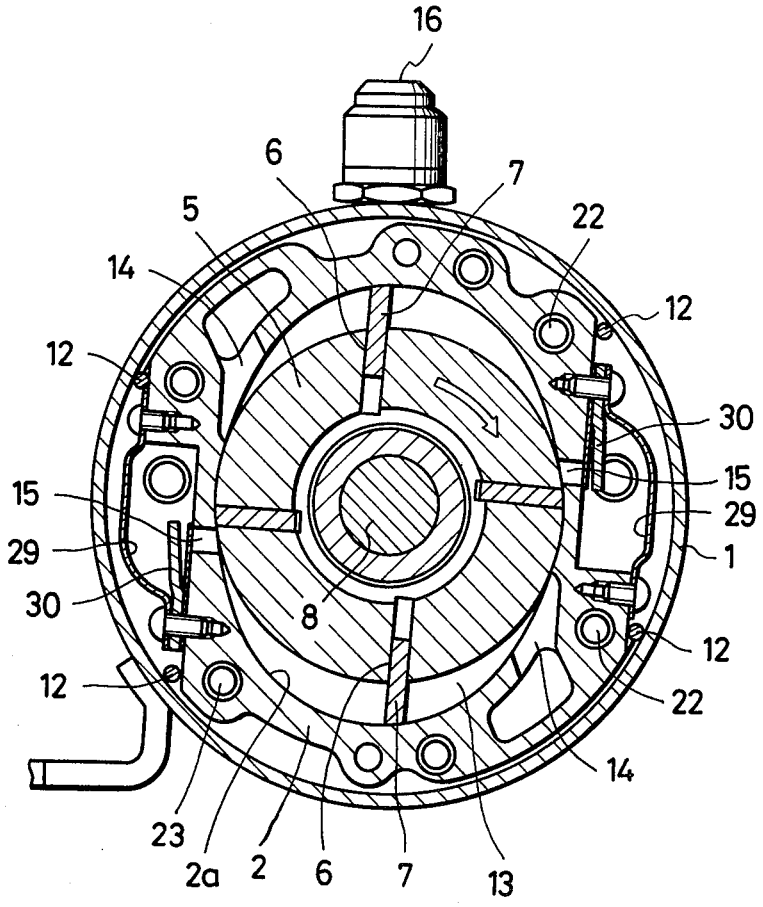
FIG. 3 is a sectional view taken along line III—III of FIG. 2.

As shown in FIG. 3, pump inlets 14 and pump outlets 15 are formed in the peripheral wall of the cam ring 2 and communicate with a compressor inlet 9 and with a compressor outlet 16 via the discharge pressure chamber 10, respectively. Fluid guide plates 29 and discharge valve assemblies 30 are mounted on the peripheral wall of the cam ring 2. Further, formed in part of the cover 1*a* forming the top wall of the discharge pressure chamber 10 is a charge and discharge port 24 for lubricating oil. Rod-like sealing members 12 are inserted between the cover 1*a* and the cam ring 2, e.g., at four places, to provide a liquid tight sealing therebetween.

Under said arrangement, when the rotary shaft 8 connected to the drive shaft of a prime mover, not illustrated, is rotated and accordingly the rotor 5 is also rotated, the vanes 7 carried by the rotor 5 are radially outwardly moved due to a centrifugal force produced by the rotation of the rotor 5 to urgedly slide on the inner peripheral cam surface of the cam ring 2.

Each time one of the vanes 7 passes each of the inlets 14 formed in the cam ring 2, a pumping chamber 13 is formed between said vane, the next or immediately following vane, the cam ring and the rotor, into which fluid is aspirated. Said chamber 13 has its volume increased from its smallest value to its largest value during its suction stroke to aspirate fluid, whereas it has its volume decreased from its largest value to its smallest value during its delivery stroke so that the fluid in the chamber 13 is pressurized to be discharged through an outlet 15. Such cyclic action is repeated, thus to carry out a pumping action.

An oil separator element 17 is disposed within the discharge pressure chamber 10, with its entire surfaces kept in contact with associated walls of the cover 1*a* and the rear side wall 4. The element 17 serves to separate the oil contained in the fluid introduced into the discharge pressure chamber 10 through the pump outlets 15, to allow the oil thus separated to be returned to an oil reservoir 18 formed at the bottom of the discharge pressure chamber 10.

The oil separator element 17 should preferably be made of a material which has a reticulate or spongy porous structure in which the component pores communicate with each other. A particularly preferable material should be a filter material of a reticulate or spongy porous structure having a small pressure loss and a high rate of arrestment of dust and viscous substances, that is, a filter material in which the pores fully communicate with each other and the skeleton or framework should be composed of elements as thin as possible insofar as they have necessary mechanical strength, thus having a high porosity. Further, the pores should be uniform in size and adjacent ones of the pores should be directed in different directions to each other so as not to form linear passages.

Most suitable for such reticulate or spongy material having continuous pores is, for instance, a porous foam composed of an organic substance such as synthetic resin, cellulose, isocyanate, particularly a porous foam having fully continuous pores obtained by removing the membranes of cells of a foam of a combustible organic substance such as soft polyurethane by a post-treatment, or a ceramic foam having completely continuous pores as disclosed, e.g., in Japanese Patent Publication No. 44-13030 issued June 11, 1969, Japanese Provisional Patent Publication No. 48-66085 issued Sept. 11, 1973 and Japanese Provisional Patent Publication No. 48-81905 issued Nov. 1, 1973, which is obtained by impregnating or coating a completely continuously porous foam composed of a combustible organic substance as mentioned above with a slurry of a ceramic material, and baking the ceramic-impregnated or coated porous foam after drying it to cause the combustible organic skeleton of the porous foam to evaporate so as to obtain a ceramic skeleton composed of pipelike skeleton elements.

Figure 6:
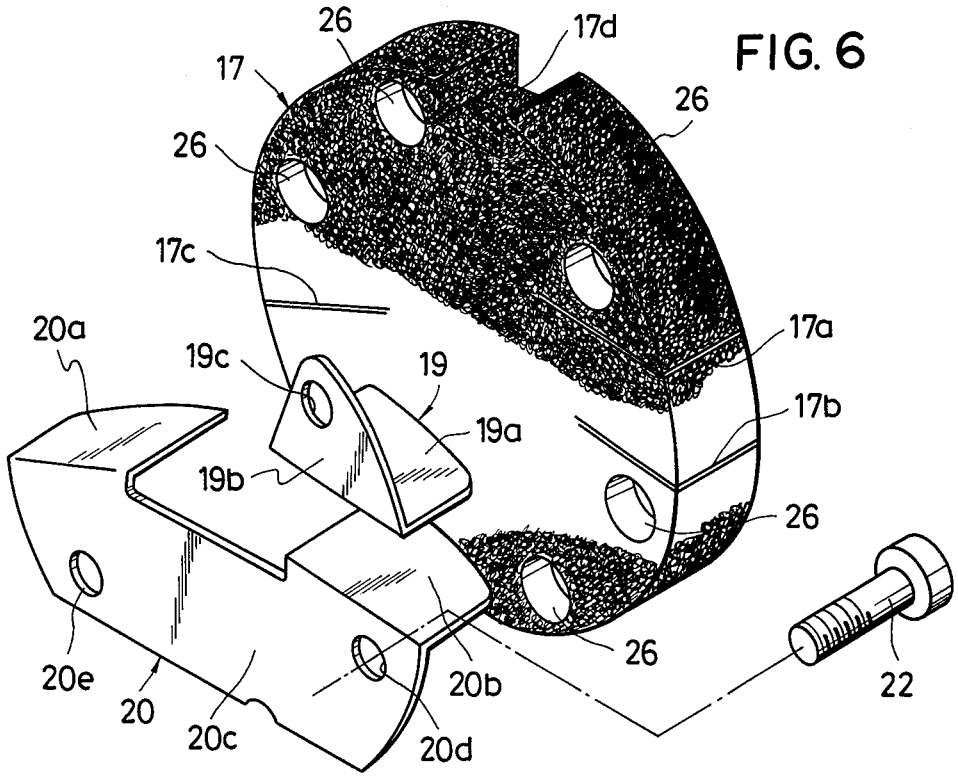
FIG. 6 is an exploded perspective view illustrating baffle boards, an oil separator element, and a fastening bolt used in the compressor of FIGS. 2 through 5.

As shown in FIG. 6, the oil separator element 17 has a generally plate-like shape of circular cross section substantially similar to the shape of the discharge pressure chamber 10, and the element 17 is disposed within the chamber 10 with its entire surfaces kept in close contact with the surfaces of the chamber 10 so that fluid introduced into the chamber 10 is necessarily forced to travel in the oil separator element 17 over a substantial distance to carry out oil separation with high efficiency. If the oil separator element 17 is made of a resilient material such as the above-mentioned porous foam of an organic substance, the whole size of the element 17 may advantageously be designed slightly larger than that of the discharge pressure chamber 10 and accordingly may be disposed within the chamber 10 in a slightly compressed fashion, which results in closer contact of the element with the inner surfaces of the chamber 10 to obtain more satisfactory oil separation results. Slits 17*a*, 17*b* and 17*c* are formed in the oil separator element 17 in a fashion extending from the peripheral lateral surface and terminating in opposite end surfaces thereof. Baffle boards 19, 20 are engaged in these slits with engaging claw portions thereof inserted in these slits. The slit 17*a* extends substantially horizontally from the peripheral lateral surface of the element 17 at a level slightly higher than associated one of the outlets 15, while the other slits 17*b*, 17*c* are diametrically oppositely formed in the element 17, extending from the peripheral lateral surface of the element 17 at a level lower than the respective outlets 15 in a fashion gradually ascending toward the center of the element 17 at very acute angles to a horizontal line. These slits 17*a*, 17*b*, 17*c* have such depths that the baffles 19, 20 engaging these slits can guide the fluid delivered through the outlets 15 to the central portion of the discharge pressure chamber 10, and at the same time space can be provided for formation of the channel 17*d* as hereinafter referred to. The upper baffle board 19 is made of a single bent plate consisting of an engaging claw portion 19*a* and a supporting portion 19*b*. The baffle board 19 is mounted on the rear side wall 4 by means of a fastening bolt 21 fitted in a bore 19*c* formed in the supporting portion 19*b*, which bolt fastens said rear side wall plate 4 to the cam ring 2. The lower baffle board 20 is made of a single bent plate consisting of a supporting portion 20*c* and a pair of engaging claw portions 20*a*, 20*b* extending integrally from left-hand and right-hand portions of the upper edge of the supporting portion 20*c* at right angles thereto and in spaced relation to each other. The lower baffle board 20 is also mounted on the rear side wall 4 by means of fastening bolts 22, 23 fitted in bores 20*d*, 20*e* formed in the supporting portion 20*c*, which bolts fasten the rear side wall plate 4 to the cam ring 2.

The claw portions 19*a*, 20*a*, 20*b* of the baffle boards 19, 20, which correspond in shape and size to the slits 17*a*, 17*b*, *17c* of the oil separator element 17, respectively, are inserted in said slits, respectively, to provide partitions in the interior of the element 17. These claws 19*a*, 20*a*, 29*b* cooperate to keep the fluid introduced into the discharge pressure chamber 10 from being dispersed and guide it toward the compressor outlet 16 so that the fluid travels in the oil separator element 17 at an increased speed.

Figure 4:
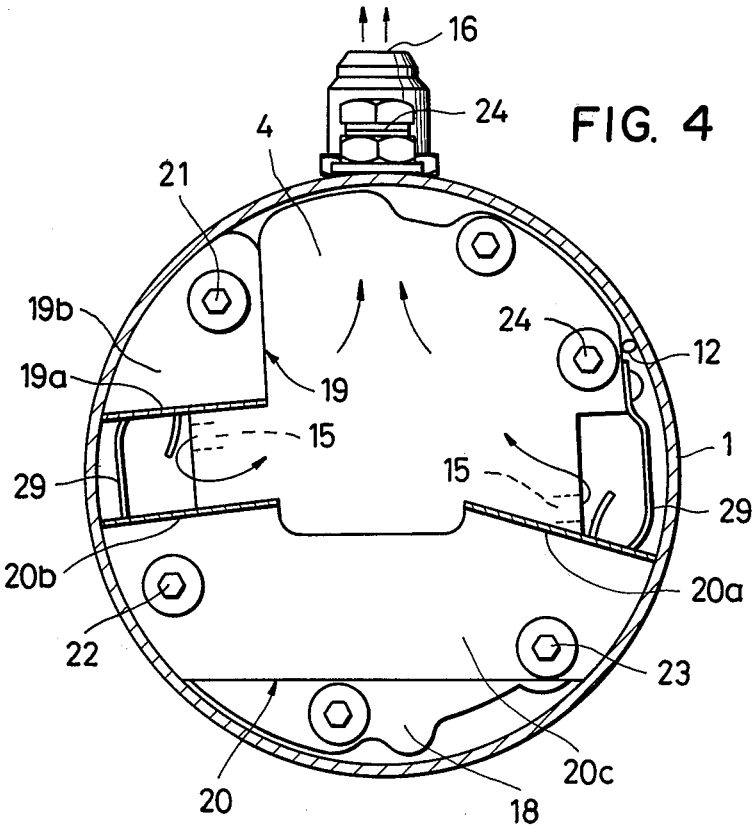
FIG. 4 is a sectional view taken along line IV—IV of FIG. 2.
Figure 5:
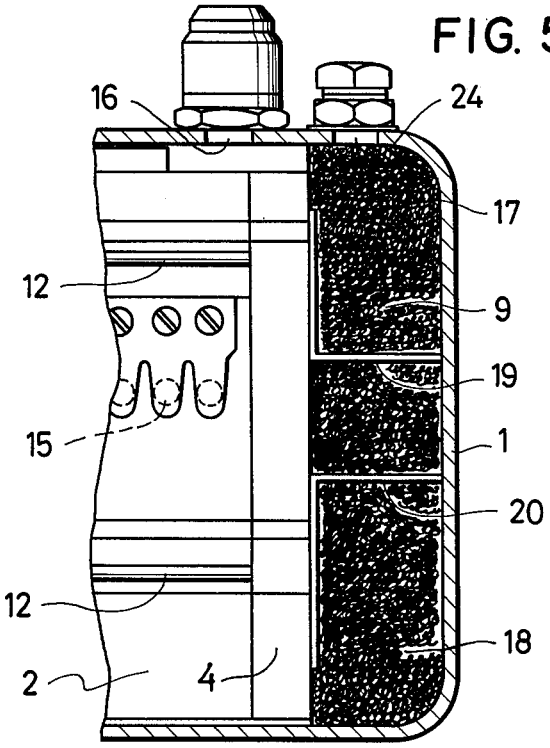
FIG. 5 is a partial side view of the compressor of FIGS. 2 through 4 with only the casing illustrated in section.

In the embodiment illustrated in FIG. 4, only one upper baffle board 19 is provided on the left-hand portion of the side wall 4 due to limited space caused by the presence of the fastening bolt 24 on the rear side wall 4. However, it is of course possible to provide a similar baffle board on the right-hand portion of the side wall 4 as well, in which case a far stronger fluid guiding effect may be obtained.

Figure 7:
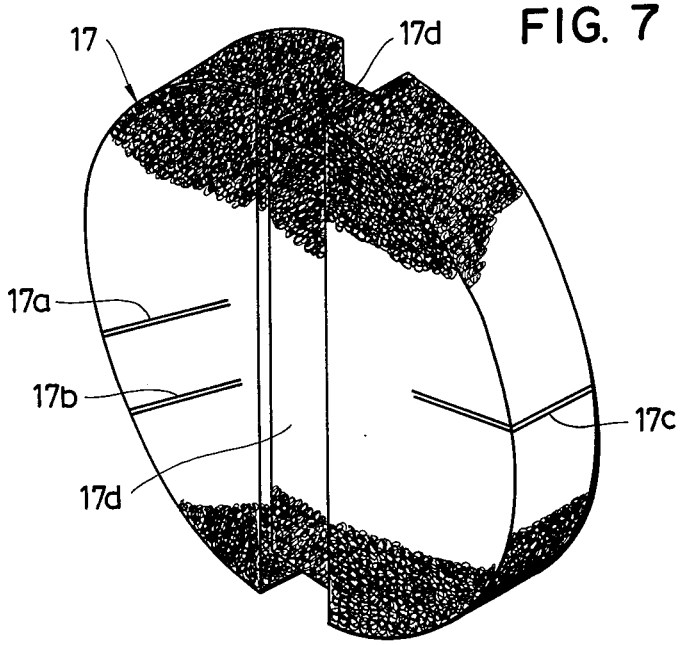
FIG. 7 is a perspective view illustrating the rear side of the oil separator element of FIG. 6.

As illustrated in FIG. 7, the oil separator element 17 is formed with a continuous channel 17*d* of a U-shaped cross section extending from a top portion of the peripheral lateral surface through an end surface thereof facing the cover 1*a* to a bottom portion of the peripheral lateral surface thereof. Thus, a passage 25 is provided by said U-shaped channel 17*d* and an associated portion of the inner surface of the cover 1*a* for communicating a charge and discharge port 24 for lubricating oil formed in top of the cover 1*a* with an oil reservoir 18 formed at the bottom of the discharge pressure chamber 10. In charging or discharging oil through the charge and discharge port 24 for new use of the compressor or for exchange of oil, the oil can flow in said passage 25. Thus, charge and discharge of oil can be carried out efficiently and easily.

Incidentally, an end surface of the oil separator element 17 facing the side wall 4 is formed with bores 26 in which the heads of fastening bolts 21, 22, etc. are to be inserted.

While a preferred embodiment of the invention has been described, such description is for illustrative purposes only, and it is to be understood that changes and variations may be made without departing from the spirit and scope of the following claims.

What is claimed is:

1. In a compressor for compressing a fluid comprising a refrigerant and an oil mixed therein, of the type including a horizontally disposed casing; a pump housing enclosed in said casing, the pump housing inlcuding first and second side walls and having an interior thereof formed as a peripheral cam surface; a rotor journalled in said pump housing and carrying a plurality of vanes radially movably inserted in a periphery thereof; drive shaft means secured to one end of said rotor; a discharge pressure chamber defined between said second side wall and an associated portion of said casing; pump outlet means formed in said pump housing in communication with said discharge pressure chamber; compressor outlet means formed in an upper portion of said casing in communcation with said discharge pressure chamber; oil charge and discharge port means formed in an upper portion of said casing facing said discharge pressure chamber; and oil separator means disposed within said discharge pressure chamber for separating oil from pressurized fluid delivered through said pump outlet means, the improvement wherein said oil separator means comprises:

an element having a reticulate or spongy porous structure having pores communicating with each other and having a shape substantially similar to that of said discharge pressure chamber, the element having a continuous channel extending from a top peripheral surface thereof through an end surface thereof facing said casing to a bottom peripheral surface thereof for cooperating with an associated inner surface of said casing to provide an oil passage, the element being disposed within the discharge pressure chamber element with substantially the entire surfaces thereof in contact with the surfaces of said chamber; and means in the discharge chamber for guiding fluid delivered to said element toward said compressor outlet means.

2. An improved vane compressor as recited in claim 1, wherein said fluid guide means comprises at least one first slit substantially horizontally extending from a peripheral surface of said element of said oil separator means at a level slightly higher than the pump outlet means; a pair of second slits diametrically oppositely formed in said element and extending from the peripheral surface thereof at a level lower than the pump outlet means in a fashion gradually ascending toward the center of said element at acute angles to a horizontal line; at least one first baffle board having an engaging claw portion engaged in said first slit; and a pair of second baffle boards having engaging claw portions engaged in associated ones of said second slits.

3. An improved vane compressor as recited in claim 1, wherein said element of said oil separator means is made of a material having a reticulate structure comprised of pipelike ceramic skeleton elements which has been formed by impregnating or coating with a ceramic material a combustible organic material of a reticulate structure obtained by removing the membranes of cells of a continuously porous foam comprised of a combustible organic substance, and baking the combustible organic material impregnated or coated with the ceramic material to evaporate an organic skeleton forming said combustible organic material.

4. An improved vane compressor as recited in claim 1, wherein said element of said oil separator means is made of a resilient material having a size slightly larger than that of said discharge pressure chamber such that it is disposed within said chamber in a slightly compressed state with entire surfaces thereof kept in close contact with the surfaces of said chamber.

5. An improved vane compressor as recited in claim 4, wherein said element of said oil separator means is made of a material having a reticulate structure formed by removing the membranes of cells of a continuously porous foam comprised of a combustible organic substance.

* * * * *